US010184365B2

(12) United States Patent
Ammann et al.

(10) Patent No.: US 10,184,365 B2
(45) Date of Patent: Jan. 22, 2019

(54) SLIDING CAM SYSTEM HAVING TWO-STAGE ACTUATOR STROKE

(71) Applicant: Schaeffler Technologies AG & Co. KG, Herzogenaurach (DE)

(72) Inventors: Matthias Ammann, Erlangen (DE); Jan Pfannenmuller, Nuremberg (DE)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 59 days.

(21) Appl. No.: 15/325,799

(22) PCT Filed: Apr. 29, 2015

(86) PCT No.: PCT/DE2015/200286
§ 371 (c)(1),
(2) Date: Jan. 12, 2017

(87) PCT Pub. No.: WO2016/012012
PCT Pub. Date: Jan. 28, 2016

(65) Prior Publication Data

US 2017/0167324 A1 Jun. 15, 2017

(30) Foreign Application Priority Data

Jul. 22, 2014 (DE) ..... 10 2014 214 259

(51) Int. Cl.
*F01L 1/34* (2006.01)
*F01L 13/00* (2006.01)
(Continued)

(52) U.S. Cl.
CPC ..... *F01L 13/0036* (2013.01); *F01L 1/042* (2013.01); *F01L 1/047* (2013.01); *F01L 2013/0052* (2013.01); *F01L 2820/031* (2013.01)

(58) Field of Classification Search
CPC ..... F01L 1/047; F01L 1/042; F01L 13/0036; F01L 2013/0052
(Continued)

(56) References Cited

U.S. PATENT DOCUMENTS 8,191,524 B2 * 6/2012 Elendt ..... F01L 13/0036 123/90.16
2010/0224154 A1 9/2010 Elendt et al.

FOREIGN PATENT DOCUMENTS

DE 102009053116 9/2010
DE 102011050484 11/2012
(Continued)

*Primary Examiner* — Ching Chang
(74) *Attorney, Agent, or Firm* — Volpe and Koenig, P.C.

(57) ABSTRACT

A sliding cam system is provided including: at least one sliding cam arranged in a fixed, but axially slideable manner on at least one axially fixed base shaft for forming a cam shaft of a reciprocating internal combustion engine; at least one actuator device for adjusting the sliding cam into different axial positions using at least one actuator pin that can engage in at least one sliding groove on a circumference of the sliding cam, wherein the actuator device has a housing attached to the engine and the sliding grooves are arranged in a groove section of the sliding cam; and a bracket encompassing the groove section using side shoulders, directed parallel to a longitudinal axis of the base shaft and provided with an opening in a region of the actuator pins, wherein the sliding cam has at least two sliding grooves having at least partially different depths, wherein the bracket is directed in the actuator device and wherein a positive-fit depth stop device is provided between the bracket and the actuator pin(s).

8 Claims, 3 Drawing Sheets

(51) Int. Cl.
*F01L 1/04* (2006.01)
*F01L 1/047* (2006.01)

(58) Field of Classification Search
USPC ..... 123/90.16, 90.18, 90.6
See application file for complete search history.

(56) References Cited

FOREIGN PATENT DOCUMENTS

| | | |
|---|---|---|
| DE | 102012103750 | 10/2013 |
| DE | 102012103751 | 10/2013 |
| WO | 2015058745 | 4/2015 |

* cited by examiner

SLIDING CAM SYSTEM HAVING TWO-STAGE ACTUATOR STROKE

BACKGROUND

The invention relates to a sliding cam system with at least one sliding cam that is arranged locked in rotation, but movable in the axial direction on at least one axially fixed base shaft for forming a camshaft of a reciprocating piston internal combustion engine, with at least one actuator device for adjusting the sliding cam into different axial positions by means of at least one actuator pin that can be engaged in at least one sliding groove on the periphery of the sliding cam, wherein the actuator device has a machine-fixed housing and the sliding grooves are arranged in a groove section of the sliding cam, and with a bracket that surrounds the groove section by means of side shoulders and is guided parallel to the base shaft and is provided with an opening in the area of the actuator pins.

Such a class-forming sliding cam system is known from DE 10 2011 050 484 A1. In that sliding cam system, the locking device is oriented perpendicular to the actuator device and is guided separately from this on a cylinder head cover of the reciprocating piston internal combustion engine. This construction therefore requires a large installation space that is not available in smaller internal combustion engines. Furthermore, the angular bracket has no axial guide, so that it is guided on the outer envelope circle of the groove section and rubs against it here. The shoulders on the bracket corresponding to the flanks of the groove section are extended in the circumferential direction and thus have a heavy construction. These extended shoulders, however, are required to be able to absorb the torque when moving from one axial position of the locking device to another. The locking device is not able to absorb additional forces here axial to the actuator pins.

SUMMARY

The objective of the invention is to improve a sliding cam system of the class-forming type so that the mentioned disadvantages are eliminated and a stable, guided bracket is provided, which is able to absorb forces and fulfill a guiding function.

According to the invention, this objective is achieved in that the sliding cam has at least two sliding grooves that have different depths at least in some parts, the bracket is guided in the actuator device, and a positive-fit depth stop device is provided between the bracket and the actuator pin(s). The guidance of the bracket in the actuator device ensures that the bracket is guided exactly and forces as well as other tasks in connection with the actuator pins can be transferred. The bracket is therefore able to form a positive-fit depth stop device for the actuator pins, through which the actuator pins are held in the sliding grooves constructed with different depths at least in some parts. Here, the switching of the depth stop device is realized by the movement of the bracket, wherein the movement of the bracket is otherwise realized by the movement of the sliding cam.

In another construction of the invention it is provided that at least one bar projecting in the direction toward the actuator pins is built on the opening and that the actuator pins have a projecting ring that is constructed as a stop on the bar. Here, the ring has a position on the actuator pin such that the end of the actuator pin contacts the groove base of the less deep sliding groove when the lower edge of the ring contacts the upper edge of the bar. The bar and the ring on the actuator pin ensure that, in this position, the relevant actuator pin can reach only the less deep sliding groove. In order to also reach the deeper sliding groove, it is provided that the bar has at least one, preferably two cut-outs whose size enables movement of the ring through the bar. Therefore, when the bracket is moved sufficiently far that the cut-out matches the allocated actuator pin, said pin can pass, together with the ring, through the cut-out so that the actuator pin also reaches, in this position of the bracket, the deeper sliding groove. If the bracket is moved in this position, the bar engages behind the ring on the opposite side and prevents the actuator pin from leaving the deeper sliding groove unexpectedly. Only when the other second cut-out again matches the actuator pin and the ring can this leave the deepest sliding groove and move back into the actuator device. To ensure this, the distance between the lower edge of the ring/upper edge of the bar and the upper edge of the ring/lower edge of the bar is essentially adapted to the difference in the depths of the sliding grooves.

The bracket can be simultaneously connected to a device for locking the sliding cam in the different axial positions, wherein depressions are provided on the bracket in which spring-loaded locking bodies guided on the actuator device engage. However, a different locking device could also be provided that has, e.g., spring-loaded locking bodies in the base shaft that correspond to inner channels on the sliding cam.

DETAILED DESCRIPTION OF THE PREFERRED EMBODIMENTS

Figure 1:
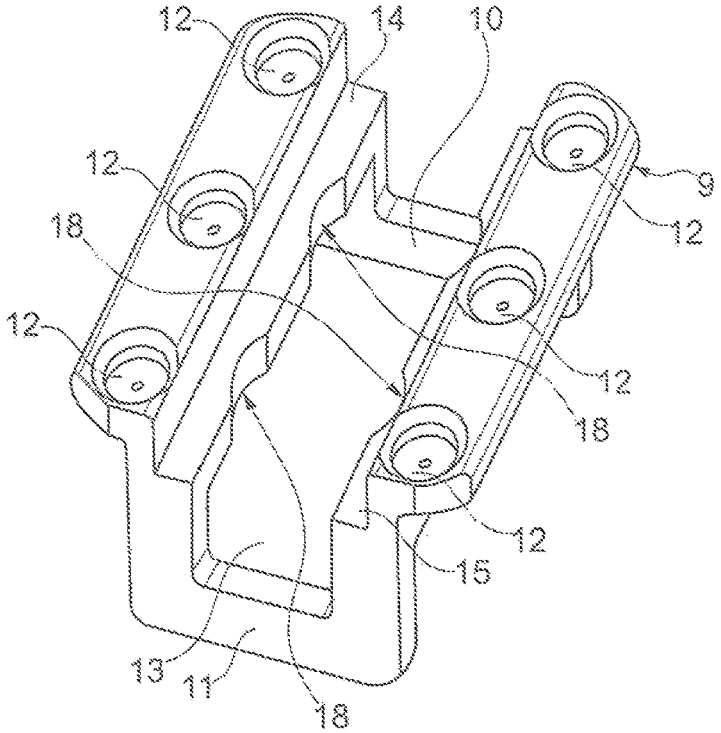
FIG. 1 shows a perspective view of a bracket of the locking device.
Figure 2:
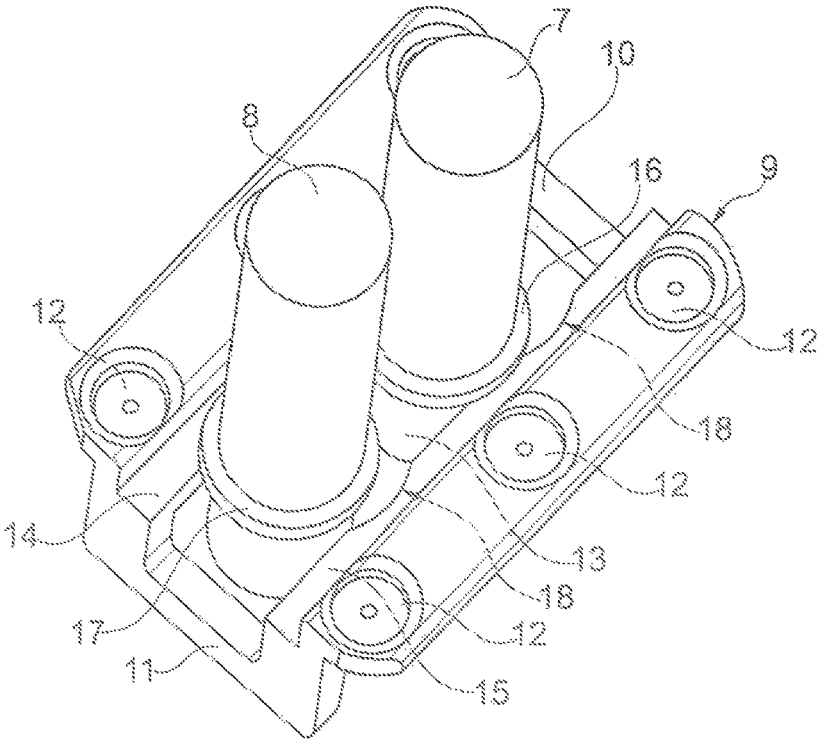
FIG. 2 shows a perspective view of the bracket similar to FIG. 1 with drawn actuator pins.
Figure 3:
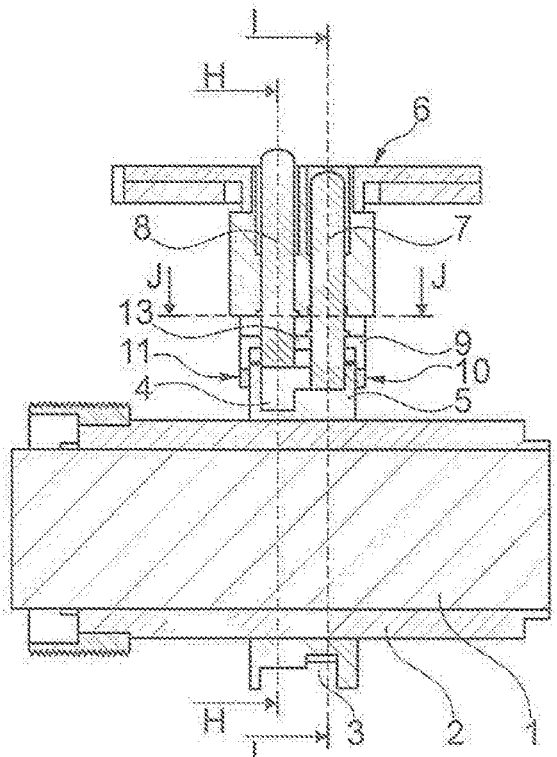
FIG. 3 shows a section radially through the base shaft, the sliding cams, and the actuator device.
Figure 4:
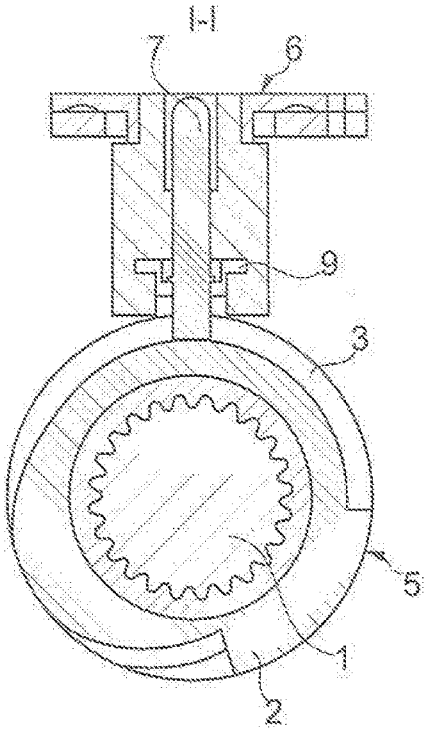
FIGS. 4 to 6 show sections corresponding to lines I-I, H-H, and J-J in FIG. 3 through the sliding cam system.
Figure 5:
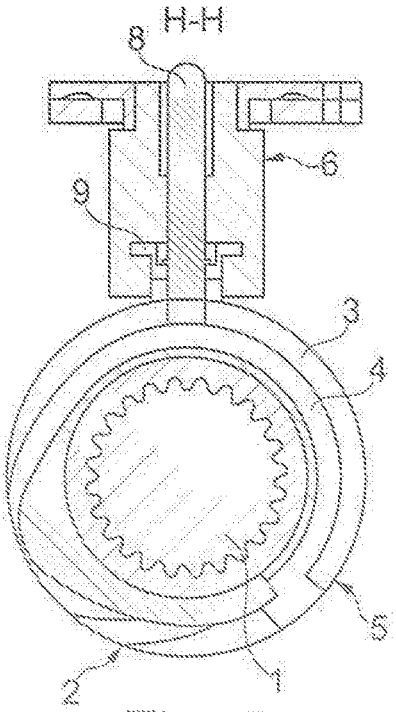
Figure 6:
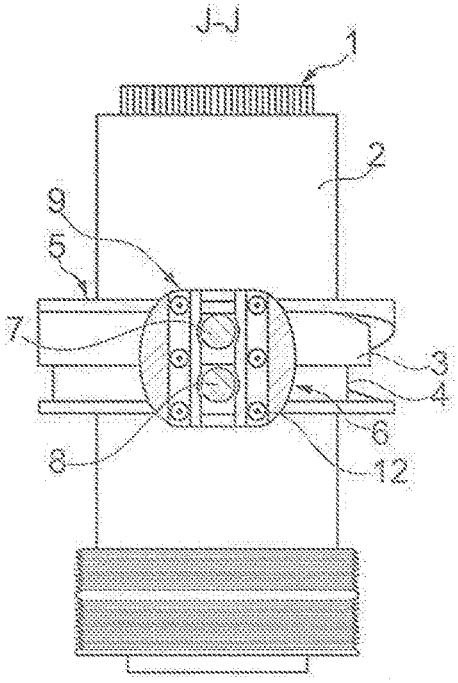
Figure 7:
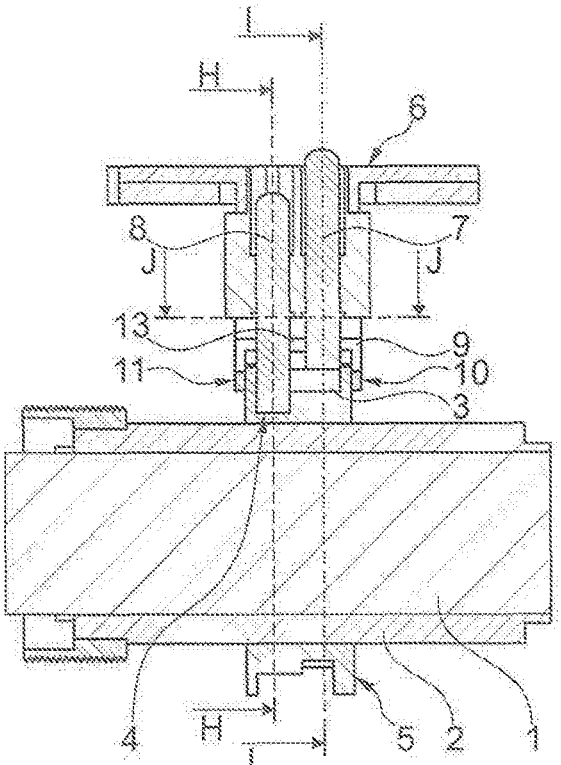
FIG. 7 shows a section corresponding to FIG. 3 with a different depth position of the actuator pins.
Figure 8:
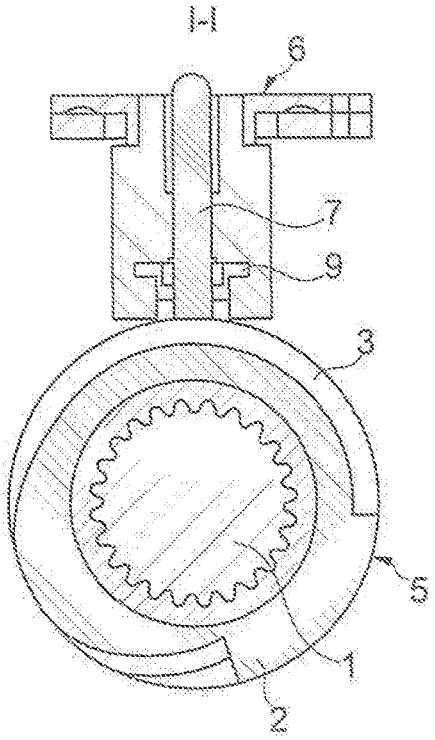
FIGS. 8 to 10 show sections corresponding to line I-I, H-H, and J-J in FIG. 7.
Figure 9:
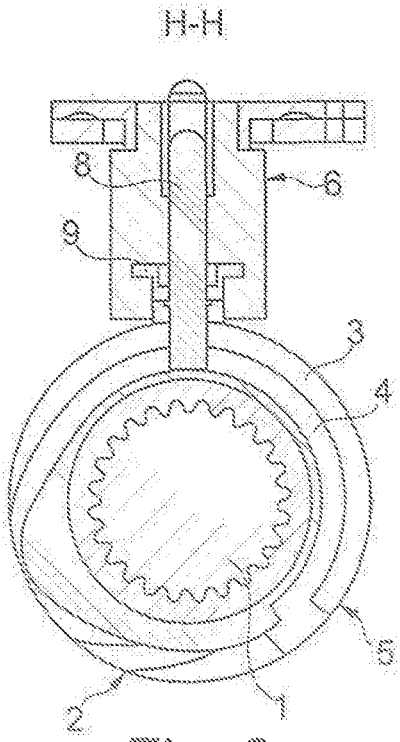
Figure 10:
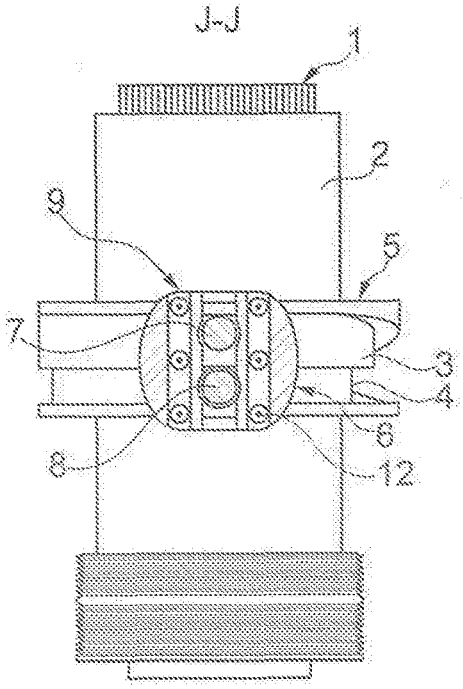

In FIGS. 1 to 10, as far as shown in detail, a base shaft is designated with 1 on which a sliding cam 2 is arranged locked in rotation but movable in the axial direction. The sliding cam 2 has a projecting groove section 5 in which two sliding cams 3 and 4 are machined. Instead of the projecting groove section, this can also be separated by grooves or recesses from the other areas of the sliding cam 2, in order to enable engagement of the shoulders 10, 11 described below. The sliding groove 3 is machined into the groove section 5 with a smaller depth, while the sliding groove 4 engages deeper into the groove section 5. An actuator device is designated with 6, which is mounted on a component, not shown, of the reciprocating piston internal combustion engine. In the actuator device 6, two actuator pins 7 and 8 are built, which can be moved, e.g., by a not-shown electromagnetic switching device in the direction toward the groove section 5 or in the counter direction and can be preferably retracted again or extended by a spring element. On the end of the actuator device 6 facing the groove section 5 there is a bracket 9 that is guided parallel to the axis of the base shaft 1. The bracket 9 has shoulders 10 and 11 that surround the groove section 5 or engage in the grooves or recesses, so that the bracket 9 is likewise moved corresponding to the movement of the sliding cam 2. The bracket 9 has, on its guide rails, depressions 12 in which spring-loaded locking bodies engage and therefore lock the bracket 9 in different positions adapted to the positions of the sliding cam 2. The bracket 9 has a central opening 13, so that the actuator pins 7 and 8 can pass through this opening. In addition to the opening 13 there are side bars 14 and 15 whose distance, apart from play necessarily present, corresponds to the diameter of the actuator pins 7 and 8. Rings 16 and 17 that are prevented from moving by the bars 14 and 15 are mounted or attached to the actuator pins 7 and 8, so that they can extend only so far that the end of the actuator pins 7 and 8 can reach the groove base of the less deep sliding groove 3. On the bars 14 and 15, cut-outs 18 are also machined, whose inner diameter corresponds to the outer diameter of the rings 16 and 17, so that for the allocated position of the bracket 9 to the actuator pins 7, 8, the rings 16, 17 and thus the actuator pins 7, 8 can pass through the cut-outs 18, so that the actuator pins 7, 8 can also reach the deeper sliding groove 4 (see, in particular, FIGS. 7 and 9).

Instead of the rings 16, 17 that can prevent the actuator pins 7 and 8 with one side from moving into and with the other side from moving out from the deeper groove 4, two recesses can also be machined on the actuator pins 7 and 8, which can take over the tasks of the rings 16, 17 for modified dimensions of the bars 14 and 15 and also of the cut-outs 18 and optionally their positions.

The bracket 9 therefore forms a positive-fit depth stop for the actuator pins 7, 8 so that these are held in the sliding grooves 3 and 4 with different depths. The bracket 9 also has sufficient strength in its position because it is guided exactly in the actuator device.

LIST OF REFERENCE NUMBERS

1) Base shaft
2) Sliding cam
3), 4) Sliding grooves
5) Groove section
6) Actuator device
7), 8) Actuator pins
9) Bracket
10), 11) Shoulders
12) Depressions
13) Openings
14), 15) Bars
16), 17) Rings
18) Cut-outs

The invention claimed is:

1. A sliding cam system comprising:

at least one sliding cam that is arranged rotationally locked but movable in an axial direction on at least one axially fixed base shaft for forming a camshaft of a reciprocating piston internal combustion engine, at least one actuator supporting at least one actuator pin, the at least one actuator adjusts the sliding cam into different axial positions by the at least one actuator pin engaging in at least one sliding groove on a periphery of the sliding cam, the at least one actuator has a machine-fixed housing, the at least one sliding groove is arranged in a groove section of the sliding cam, a bracket surrounds the groove section by side shoulders thereof and is guided parallel to a longitudinal axis of the at least one axially fixed base shaft, and the bracket is provided with an opening adapted to receive the at least one actuator pin, wherein the at least one sliding groove includes two sliding grooves in the sliding cam that have at least partially different depths, the bracket is guided in the at least one actuator, and the bracket forms a positive-fit depth stop for the at least one actuator pin.

2. The sliding cam system according to claim 1, wherein adjustment of the positive-fit depth stop is realized by shifting the bracket.

3. The sliding cam system according to claim 1, wherein at least one bar projecting in a direction toward the at least one actuator pin is built on the bracket adjacent to the opening and the at least one actuator pin has a projecting ring that is formed as a stop that contacts the at least one bar.

4. The sliding cam system according to claim 3, wherein the projecting ring has a position on the at least one actuator pin such that an end of the at least one actuator pin contacts a groove base of a less deep one of the sliding grooves when a bottom edge of the projecting ring contacts an upper edge of the at least one bar.

5. The sliding cam system according to claim 4, wherein the at least one bar has at least one cut-out having a size that allows movement of the projecting ring through the at least one bar.

6. The sliding cam system according to claim 5, wherein a distance between the bottom edge of the projecting ring/an upper edge of the at least one bar and an upper edge of the projecting ring/a lower edge of the at least one bar essentially corresponds to a difference in depth of the sliding grooves.

7. The sliding cam system according to claim 1, wherein at least one recess is provided in a wall of the at least one actuator pin.

8. The sliding cam system according to claim 7, wherein the at least one recess is machined.

* * * * *